United States Patent [19]

Jardine et al.

[11] 4,090,433

[45] May 23, 1978

[54] PRODUCTION OF CARTON BLANKS

[75] Inventors: Robert William Jardine, Bramhall; Frederick Paul Johnson, Audenshaw, both of England

[73] Assignee: Simon Container Machinery Limited, Stockport, England

[21] Appl. No.: 752,525

[22] Filed: Dec. 20, 1976

[30] Foreign Application Priority Data

Jan. 15, 1976 United Kingdom ..... 1533/76

[51] Int. Cl.[2] ..... B31B 1/22

[52] U.S. Cl. ..... 93/58.2 R; 83/495; 83/699

[58] Field of Search ..... 93/58.2 R, 58 R, 58.4, 93/58.2 F, 1 G; 83/499, 498, 698, 699, 500–503, 495

[56] References Cited

U.S. PATENT DOCUMENTS

| | | | |
|---|---|---|---|
| 3,093,037 | 6/1963 | Ward, Jr. | 93/58.2 R |
| 3,257,882 | 6/1966 | Lulie et al. | 93/58.2 R X |
| 3,443,490 | 5/1969 | Bishop | 93/58.2 R |
| 3,466,982 | 9/1969 | Sullivan | 93/58.2 R |
| 3,651,723 | 3/1972 | Gallagher, Jr. et al. | 83/499 X |
| 3,952,637 | 4/1976 | Lambert et al. | 83/699 X |
| 4,003,300 | 1/1977 | Grobman | 93/58.2 R |

*Primary Examiner*—James F. Coan
*Attorney, Agent, or Firm*—Norris & Bateman

[57] ABSTRACT

Creasing and slotting apparatus for use in producing carton blanks from a moving sheet of material, the apparatus comprising a pair of driven shafts one of which carries rotary creasing heads each having a formation adapted to engage the moving sheet to crease same, and the other carries rotary slotting heads aligned respectively with said creasing heads in the direction of travel of the sheet and each having a pair of spaced arcuate slotting blades one of which is movable with respect to the other around the axis of the associated shaft such that the distance between the blades and thus the slots cut thereby is adjustable, there being a first compensator means for selectively rotating the slotting heads while the associated shaft is stationary or in motion, to enable the heads to be positioned in register relative to the moving sheet, and second compensator means for selectively rotating the shaft carrying the creasing heads in a likewise manner, there being a driving connection between said creasing head shaft and each movable slotting blade on the other shaft, whereby the relative positions of the fixed and movable blades can be adjusted during drive.

9 Claims, 7 Drawing Figures

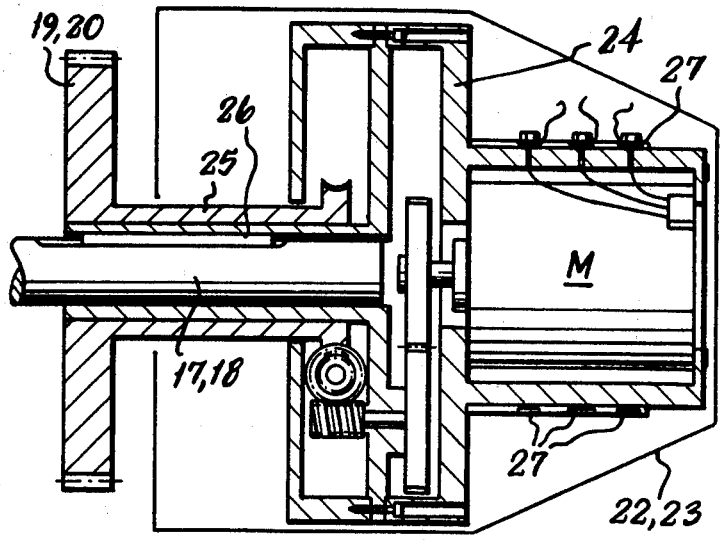
FIG. 3
FIG. 6
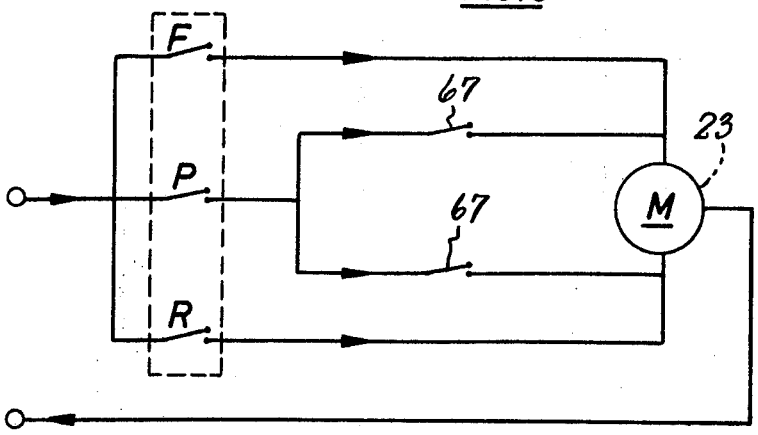

PRODUCTION OF CARTON BLANKS

This invention relates to converting machinery for producing carton blanks from corrugated board or the like and is particularly concerned with creasing and slotting apparatus arranged to work a continuously moving sheet of board thus to determine the dimensions of cartons to be produced therefrom.

Machinery of this kind usually includes, inter alia, a pair of driven parallel shafts carrying respectively one or more rotary creasing heads and one or more rotary slotting heads. Each creasing head has a peripheral annular formation which together with a rotary anvil forms a nip between which the moving board passes to be creased continuously in its direction of travel. Each slotting head, being operatively aligned with an associated creasing head carries a pair of spaced arcuate slotting blades which during rotation coincide with an anvil positioned below the moving board to cut the latter to form slots therein. The relative circumferential positions of the slotting blades are adjustable to determine the location and distance apart of the slots.

It is known to provide a compensator motor on the shaft carrying the slotting heads selectively to rotate said shaft and thus the slotting heads to enable the latter to be positioned relative to the moving board whilst the shaft is in motion and independently of the drive thereto or alternatively, when the shaft is not being driven. This is to ensure that the blades cut the board in correct register with, for example, printed matter thereon.

However, in order to adjust the circumferential distance apart of the blades and thus the slots cut thereby, for determining the dimensions of the carton to be produced, it is usually necessary to stop the entire machine, and to make adjustments by hand.

Certain systems have been proposed for driving one blade relative to the other whilst the shaft is in motion, but these have been largely unsatisfactory owing to their complex and bulky nature.

An object of the present invention is to provide improved creasing and slotting apparatus for use in converting machinery, wherein the relative positions of a pair of slotting blades mounted on one shaft can be adjusted whilst the shaft is in motion.

According to the present invention there is provided creasing and slotting apparatus for producing carton blanks from a moving sheet of material, comprising a first driven shaft carrying at least one rotary creasing head having a formation adapted continuously to engage said moving sheet to crease same, a second driven shaft carrying at least one rotary slotting head aligned, in the direction of travel of said sheet, with said creasing head and having a pair of spaced arcuate slotting blades adapted to cut said sheet, one of said blades being movable relative to the other around the axis of said shaft such that the distance between the blades, and thus the slots cut thereby, is adjustable, first compensator means for selectively rotating said second shaft and thus said slotting head whilst the shaft is stationary or in motion, to enable the slotting head to be positioned in register relative to said moving sheet, and second compensator means for selectively rotating said first shaft in likewise manner, there being a driving connection between said first shaft and the movable slotting blade on said second shaft, whereby the relative positions of said fixed and movable blades can be adjusted during drive.

An embodiment of the invention will now be described by way of example only, with reference to the accompanying drawings in which:

FIG. 3 is a section illustrating the internal construction of a compensator device;

Figure 5A:
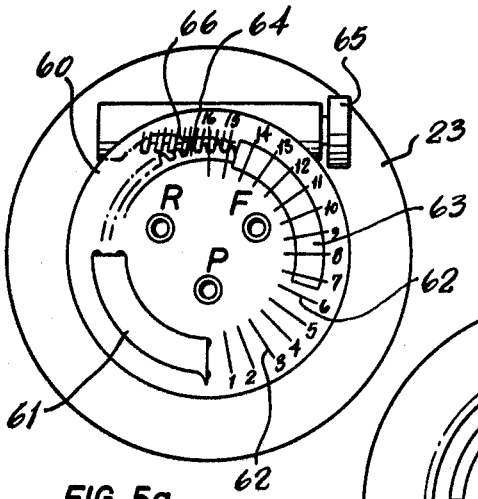
Figure 5B:
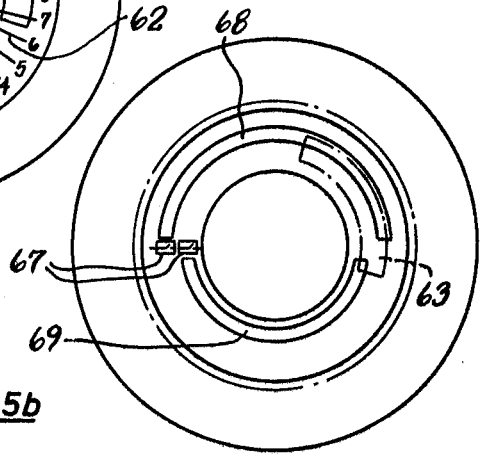

FIGS. 5*a* and 5*b* illustrate the external and internal constructions respectively of one compensator device; and FIG. 6 shows diagramatically a circuit for supplying power to a compensator device.

Figure 1:
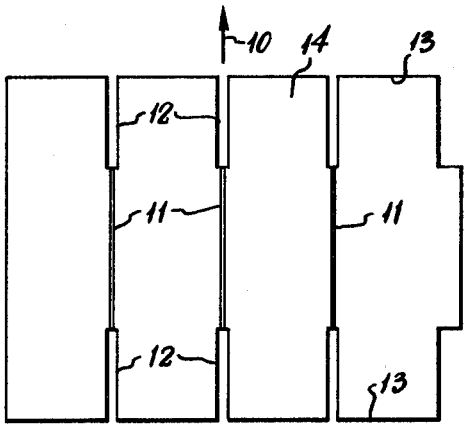
FIG. 1 shows one form of carton blank which can be produced by the apparatus of the present invention.

In the production of carton blanks of the kind illustrated in FIG. 1, a continuous sheet of corrugated board passes through a converting machine in the direction of arrow 10. As it progresses through the machine a number of continuous creases 11 are created in the board as will be described. Also at pre-selected intervals, slots 12 are cut which when the board is cross-cut as at 13, form the flaps 14 used to close the carton. The creases 11 enable the blank to be manipulated to form the corners of the carton.

Figure 2:
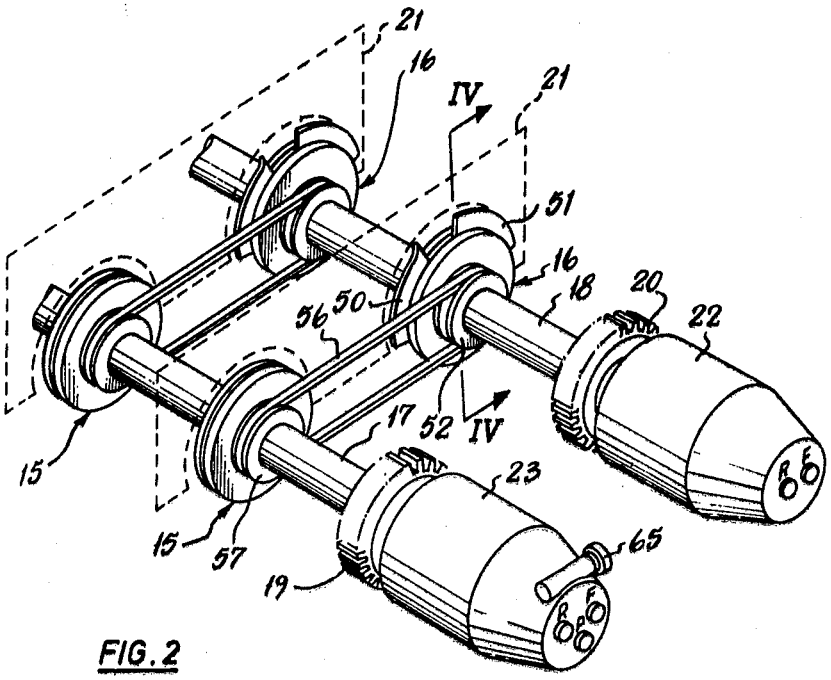
FIG. 2 is a schematic perspective view of two pairs of creasing and slitting heads mounted on respective shafts.

To produce the creases and slots referred to above there is provided apparatus in a converting machine including several pairs of creasing and slotting heads generally indicated at 15 and 16 in FIG. 2, mounted respectively on driven shafts 17 and 18. The shafts 17 and 18 are driven in synchronism via pinions or chain wheels 19 and 20 respectively and a common drive belt or chain which is driven by the main machine drive which also drives the moving sheet of board. Each aligned pair of heads 15, 16 is attached to a yoke 21 which by means of a lead screw or similar device can be advanced along the shafts 17, 18 to select the positions across the moving sheet where creases and slots are to be made. In this way therefore the operator can set up the apparatus for the required width-wise dimensions, with respect to the direction of travel of the sheet, of the carton to be produced, without gaining manual access to the heads.

It will be appreciated that corrugated board fed to the apparatus may already have printed matter thereon so that it is important to determine the exact positions of the slots produced therein. For this purpose, a pair of compensator devices 22 and 23 are mounted on the ends of the shafts 17 and 18 respectively.

Each compensator device (see FIG. 3) comprises an electric motor M which, through a system of pinions and worm gears, can cause the body 24 upon which it is mounted, to rotate about a sleeve 25 integral with or attached to the pinion 19, 20. The shaft 17, 18 upon which the compensator is mounted is keyed at 26 rigidly to the body 24 for rotation therewith. Slip rings 27 are provided to energise the motor M. In this way therefore, irrespective of rotation of the pinion 19, 20 from the main machine drive, the shaft 17, 18 can be driven in either direction by energising the motor M accordingly. Clearly, if the motor is stationary then the pinion 19, 20 and shaft 17, 18 rotate together. Therefore, the shaft 18 can be selectively rotated independently of the main drive thereto by selectively energising the motor M in the compensator device 22. As can be seen from FIG. 6.

FORWARD and REVERSE buttons F and R are provided for this purpose.

Figure 4:
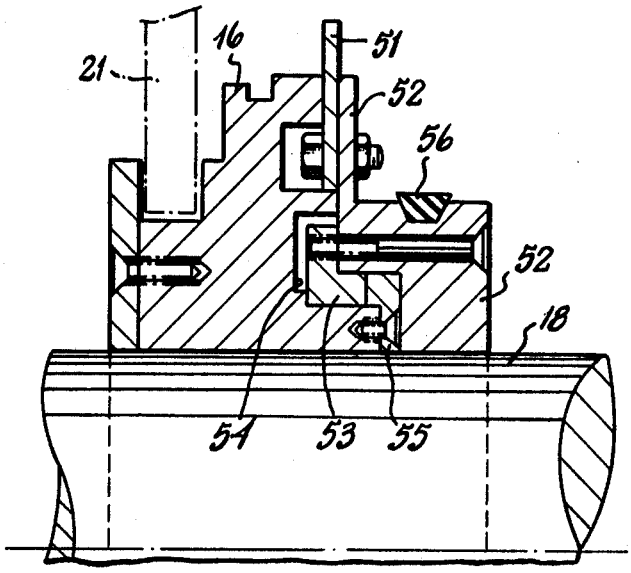
FIG. 4 is a partial section taken on line IV—IV of FIG. 2.

Each slotting head carries a fixed arcuate slotting blade 50 and a further blade 51 which is adjustable in position around the circumference of the head 16 relative to the fixed blade 50. The movable blade 51 is free to rotate around the shaft 18. To this end, the blade 51 is removably bolted to a flanged boss 52 (See FIG. 4) which is secured to an annular ring 53 slidable within an annular slot 54 and retained therein by a ring 55 bolted to the head 16.

Wrapped around the flanged boss 52 is a continuous toothed drive belt 56 which also wraps a similar boss 57 rigidly attached to the associated creasing head 15 mounted on the shaft 17.

The second compensator device 23 is adapted, via the drive belt 56 to rotate the flanged boss 52 and thus the movable blade 51 on the shaft 18. In this way therefore, the circumferential position of the blade 51 can be selectively adjusted relative to that of the fixed blade 50 and thereby the distance apart of the slots cut in the moving sheet, and thus the depth of the carton to be produced, can be determined. Except during such adjustment, the blades 50 and 51 are maintained in fixed relationship by the belt 56, the shafts 17 and 18 being normally driven in synchronism.

By simultaneous operation of the compensators 22 and 23, which is automatically effected by actuation of the button F or R on compensator 22, the instantaneous angular position of the slotting and creasing heads can be determined thus to bring the blades of the slotting head into register with the moving sheet of board.

A device for setting up the apparatus is provided and illustrated in FIGS. 5*a* and 5*b*.

In known apparatus incorporating a compensator on the slotting head shaft it is usual to provide a "parking" device to ensure that at the end of a production run, or immediately preceding the next run, the leading edge of the fixed knife blade is brought to a predetermined datum position such as bottom-dead-centre, and it will be assumed for the purpose of this description that such a device (although not shown) is provided here.

FIGS. 5*a* and 5*b* illustrate the external and internal constructions respectively of the end casing of the compensator 23. The end face 60 thereof is transparent and is marked with an outline 61 representing the position of the fixed knife blade on the shaft 18 as determined by the "parking" device. Also marked on the face 60 are graduations 62 against which the position of the movable knife blade is to be determined. Within the casing an arcuate member 63 representing the movable knife blade 51 is mounted on a toothed ring 64 and is rotatable about a central axis. A hand wheel 65 is provided to rotate a worm 66 in meshing engagement with the toothed ring 64. Thus, by rotating the wheel 65 the position of the member 63 relative to the graduations 62, and thus the desired relative positions of the fixed and movable blades, can be represented. Also attached to the ring 64 are a pair of reed switches 67. A pair of radially displaced arcuate magnetic strips 68 and 69 are attached to the rear face of the motor casing 24 of the compensator 23 and during rotation of the latter, are adapted to pass beneath the reed switches 67. Therefore, if the member 63 is preset by the hand wheel 65 such that one of the reed switches lies over one of the magnetic strips 68, 69 then, upon energisation by actuation of a "preset" button P, this reed switch will be closed and the motor M of compensator 23 energised accordingly with the appropriate polarity to drive the shaft 17 in the appropriate direction until the gap between the strips 68 and 69 coincides with the position of the reed switches at which time the closed switch opens and drive is discontinued.

The circuit shown in FIG. 6 enables the motor M of compensator 23 to be energised in different directions according to selective actuation of buttons F and R whilst shaft 17 is stationary or in drive, and, when button P is depressed, by magnetic actuation of one of the reed switches 17 is appropriate. Button P can be actuated only when the shaft 17 is stationary, as, during rotation, the magnetic strips 68, 69 are in rotation also. The push buttons on the compensators will preferably be spring-loaded with a mechanical or electrical interlock system whereby only one button at a time can be operative.

It is not intended to limit the invention to the above example only, many variations, such as might readily occur to one skilled in the art being possible without departing from the scope of the invention.

Thus for example, the flexible belt 56 drivingly connecting each creasing head 15 to its associated movable knife blade 51 can be replaced by a system of gears, or other driving means.

What is claimed is:

1. Creasing and slotting apparatus for producing carton blanks from a moving sheet of material, comprising a first driven shaft carrying at least one rotary creasing head having a formation adapted continuously to engage said moving sheet to crease same, a second driven shaft carrying at least one rotary slotting head aligned, in the direction of travel of said sheet, with said creasing head and having a pair of circumferentially spaced apart arcuate slotting blades adapted to cut said sheet, one of said blades being movable relative to the other around the axis of said shaft such that the distance between the blades, and thus the slots cut thereby, is adjustable, first compensator means for selectively rotating said second shaft and thus said slotting head while the shaft is stationary or in motion, to enable the head to be positioned in register relative to said moving sheet, and second compensator means for selectively rotating said first shaft in likewise manner, there being a driving connection between said first shaft and the movable slotting blade on said second shaft, whereby the relative positions of said fixed and movable blades can be adjusted during drive.

2. Creasing and slotting apparatus according to claim 1, wherein said movable blade is fixed to a member rotatably mounted on said second shaft, there being a toothed drive belt connecting said member to a further member mounted on said first shaft.

3. Creasing and slotting apparatus according to claim 1, wherein said movable blade is fixed to a member rotatably mounted on said second shaft, there being a system of gears drivingly connecting said member to a further member mounted on said first shaft.

4. Creasing and slotting apparatus according to claim 1, wherein each said compensator means includes a motor, the normal drive for each said driven shaft being drivingly connected to the motor of the associated compensator means, the motor body being connected to said shaft.

5. Creasing and slotting apparatus according to claim 1, including means for actuating said first and second compensator means simultaneously thereby to adjust the rotational position of said slotting head to ensure correct register of the blades thereof with a moving sheet of material.

6. Creasing and slotting apparatus according to claim 1, including means for actuating said second compensator means independently of said first compensator means, thereby selectively to drive said movable slotting blade relative to said fixed slotting blade.

7. Creasing and slotting apparatus according to claim 1, inlcuding parking means adapted to ensure that the operative leading edge of the fixed knife blade in said slotting head is brought to a predetermined datum position prior to operation, there being means on said second compensator means for presetting the position of said movable blade relative to said fixed blade when the latter is positioned by said parking means, whereby said fixed and movable slotting blades can take up correct relative positions prior to operation.

8. Creasing and slotting apparatus according to claim 7, wherein said presetting means includes an adjustable rotary member representing the desired position of said movable blade relative to said datum position of said fixed blade, said member carrying a pair of proximity switches in circuit with the motor of said second compensator means, there being a pair of arcuate magnetic strips attached to said motor and arranged to pass close to said switches, further means being provided to energise said second compensator motor via one of said switches in the event of coincidence of one such strip therewith, said motor and thus said movable blade being thus driven in the appropriate direction until said switch and said strip are out of coincidence in which position drive is discontinued and said movable blade is correctly located.

9. Creasing and slotting apparatus according to claim 1, including a plurality of pairs of rotary creasing and slotting heads, each pair being connected to a member movable parallel to the axes of said shafts to adjust the relative positions of said pairs along said shafts.

* * * * *